US009947498B2

(12) United States Patent
Weister et al.

(10) Patent No.: US 9,947,498 B2
(45) **Date of Patent: *Apr. 17, 2018**

(54) ELECTRICAL SWITCHING APPARATUS AND CLINCH JOINT ASSEMBLY THEREFOR

(71) Applicant: Eaton Corporation, Cleveland, OH (US)

(72) Inventors: Nathan J. Weister, Darlington, PA (US); Paul Richard Rakus, Beaver Falls, PA (US); Edward A. Prince, Aliquippa, PA (US); William Charles Pollitt, Murrysville, PA (US)

(73) Assignee: EATON INTELLIGENT POWER LIMITED, Dublin 4 (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/620,855

(22) Filed: Jun. 13, 2017

(65) Prior Publication Data

US 2017/0278661 A1 Sep. 28, 2017

Related U.S. Application Data

(63) Continuation of application No. 14/943,228, filed on Nov. 17, 2015, now Pat. No. 9,805,895.

(51) Int. Cl.

| | |
|---|---|
| ***H01H 71/12*** | (2006.01) |
| ***H01H 1/22*** | (2006.01) |
| ***H01H 1/58*** | (2006.01) |

(52) U.S. Cl.

CPC ..... *H01H 71/128* (2013.01); *H01H 1/226* (2013.01); *H01H 1/5822* (2013.01); *H01H 2205/002* (2013.01)

(58) Field of Classification Search

CPC .... H01H 1/226; H01H 1/5833; H01H 1/5822; H01H 71/0257; H01H 71/2472; H01H 71/525

(Continued)

(56) References Cited

U.S. PATENT DOCUMENTS

| | | | |
|---|---|---|---|
| 4,245,203 | A | 1/1981 | Wafer et al. |
| 5,032,813 | A | 7/1991 | Gula et al. |

(Continued)

FOREIGN PATENT DOCUMENTS

| | | |
|---|---|---|
| EP | 1912229 | 4/2008 |

*Primary Examiner* — Ahmed Saeed

(74) *Attorney, Agent, or Firm* — Eckert Seamans

(57) ABSTRACT

A movable contact assembly for an electrical switching apparatus is provided. The movable contact assembly includes a number of shunts, and, a carriage assembly including two sidewalls and a contact arm assembly. The carriage assembly sidewalls are disposed in a spaced relation. The contact arm assembly includes a plurality of contact arms, a number of isolation members, a number of movable contacts, and an axle. Each contact arm defines an opening. One movable contact is disposed on each contact arm. Each contact arm is rotatably coupled to the axle with the axle extending through the contact arm opening. Each isolation member is disposed adjacent at least one contact arm. Each isolation member is coupled to, and in electrical communication with the adjacent contact arm. The shunts are coupled to, and in electrical communication with, the isolation members. In this configuration, no shunt operatively engages a contact arm.

20 Claims, 8 Drawing Sheets

(58) Field of Classification Search
USPC .... 200/401, 244, 11 TC, 238, 271; 218/120, 218/154, 140; 335/167, 172, 191
See application file for complete search history.

(56) References Cited

U.S. PATENT DOCUMENTS

| | | | | |
|---|---|---|---|---|
| 5,200,724 | A | 4/1993 | Gula et al. | |
| 6,005,206 | A | 12/1999 | Rakus et al. | |
| 7,646,269 | B2 | 1/2010 | Weister et al. | |
| 2003/0038695 | A1 | 2/2003 | Kramer | |
| 2008/0088093 | A1 * | 4/2008 | Weister | H01H 71/0207 277/345 |
| 2008/0088394 | A1 | 4/2008 | Weister et al. | |
| 2008/0289943 | A1 | 11/2008 | Kakisako et al. | |
| 2014/0009250 | A1 | 1/2014 | Cho | |

* cited by examiner

ELECTRICAL SWITCHING APPARATUS AND CLINCH JOINT ASSEMBLY THEREFOR

CROSS REFERENCE TO RELATED APPLICATION

This application is a continuation application of and claims priority to U.S. patent application Ser. No. 14/943,228, filed Nov. 17, 2015 entitled ELECTRICAL SWITCHING APPARATUS AND CLINCH JOINT ASSEMBLY THEREFOR.

BACKGROUND

Field

The disclosed concept relates generally to electrical switching apparatus and, more particularly, to an electrical switching apparatus such as a circuit breaker. The disclosed concept also relates to clinch joint assemblies for circuit breakers.

Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions. The operating mechanism is designed to rapidly open and close separable contacts. The operating mechanism is structured to be latched and thereby maintain the contacts in a closed configuration. A trip unit is structured to detect over-current conditions. When an over-current condition is detected, the trip unit releases the operating mechanism latch thereby allowing biasing elements to bias the operating mechanism and contacts, to an open configuration. Generally, a circuit breaker is assigned a size and a "withstand" value. The size of the circuit breaker is substantially related to the size of the circuit breaker housing assembly or frame. The circuit breaker withstand value involves a balance between blow-off forces generated by electric currents flowing in the breaker and contact forces generated on the movable conductor by the operating mechanism.

Many low-voltage circuit breakers, employ a molded housing having two parts, a first half or front part (e.g., a molded cover), and a second half or rear part (e.g., a molded base). The operating mechanism for such circuit breakers is often mounted to the front part of the housing, and typically includes an operating handle and/or button(s) which, at one end, is (are) accessible from the exterior of the molded housing and, at the other end, is (are) coupled to a pivotable pole shaft. Electrical contact assemblies, which are also disposed within the molded housing, generally comprise a conductor assembly including a movable contact assembly having a plurality of movable contacts, and a stationary contact assembly having a plurality of corresponding stationary contacts. The movable contact assembly is electrically connected to a generally rigid conductor of the conductor assembly by flexible conductors, commonly referred to as shunts. The movable contact assembly includes a plurality of movable contact arms or fingers, each carrying one of the movable contacts and being pivotably coupled to a contact arm carrier. The contact arm carrier is pivoted by a protrusion or arm on the pole shaft of the circuit breaker operating mechanism to move the movable contacts between an open, first position (not shown), wherein the movable contacts are not coupled to, and are not in electrical communication with, the corresponding stationary contacts, and a closed, second position (contact arm 58D, described below, is shown in the second position in FIG. 1), wherein the movable contacts are coupled to, and are in electrical communication with, the corresponding stationary contacts. The contact arm carrier includes a contact spring assembly structured to bias the fingers of the movable contact assembly against the stationary contacts of the stationary contact assembly in order to provide and maintain contact pressure when the circuit breaker is closed, and to accommodate wear.

The shunts typically comprise either copper wire ropes or layered copper ribbons, and are solidified at their ends using heat and pressure and then brazed to the rigid conductor at one end, and to the movable contact assembly contact arms at the opposite end. One of the disadvantages associated with known wire rope or braided-type shunts is that they do not fit well within the limited spacing which is available between the adjacent contact arms of the movable contact assembly. Specifically, the body of such shunts tends to expand outward and occupy more than the width of the finger, thus interfering with adjacent structures. The wire ropes also tend to bunch together during short circuit events, thus inhibiting the flexibility of the assembly. This is problematic in view of the compound motion which the fingers experience as a result of the well-known "heel-toe" and/or "blow-on" arcing schemes which are commonly employed by low-voltage circuit breakers. See, e.g., U.S. Pat. No. 6,005,206.

To accommodate the movement of the contact finger during separation from a stationary contact, an elongated shunt is typically disposed in an "S" shape for use, i.e., a "use shape." That is, as used herein a "use shape" is the overall shape of the shunt, as opposed to, for example, the cross-sectional shape, of a shunt prior to an over current event. This may also be identified as the "resting shape." In an electrical switching apparatus having a greater withstand value, e.g., a circuit breaker structured for a higher voltage, elongated shunts create magnetic fields during an overcurrent event. Such magnetic fields from adjacent shunts, as well as the movement caused by the operating mechanism, cause the shunt to rapidly change shape in an extreme compound deflection, or colloquially, an extreme "wiggle," during an over current event. This motion causes the shunt to wear and creates uncontrollable forces that affect the carrier and contact arms.

Layered ribbon-type shunts also suffer from a number of unique disadvantages. Among them is the fact that they are typically V-shaped, thus having a single relatively sharp bend which undesirably creates an area of stress concentration. This V shape also consumes a substantial amount of valuable space within the molded housing of the circuit breaker.

Thus, there is a problem with the size and configuration, including the use shape, of shunts. That is, shunt loads are not isolated from the movable contact assembly contact arms, and, longer shunts are subject to extreme compound deflection.

Further, when a current is passing through the shunts, the shunts have a magnetic field that produces forces that act upon other elements of the electrical contact assemblies. These magnetic fields and corresponding forces are variable due to the variable configuration of the shunts, i.e., when the wire ropes also tend to bunch together during short circuit events. This is a disadvantage as the variable forces enhance, or detract from, the opening forces created by the operating mechanism. That is, having an operating mechanism that has variable opening characteristics is a disadvantage.

One improvement relating to electrical contact assemblies is the use of a clinch joint assembly. A clinch joint assembly eliminates the shunts by including a slotted conductor having a bifurcated member, such as a yoke, supporting an axle member. The movable contact assembly contact arm is rotatably disposed on the axle. The yoke is laterally biased against the movable contact assembly contact arm, i.e., the yoke holds the movable contact assembly contact arm tightly or "clinches" the movable contact assembly contact arm. The lateral bias creates a torque on the movable contact assembly contact arm that resists rotation. The slotted conductor is coupled to the conductor assembly. Thus, electricity flows through the conductor assembly, the slotted conductor, and the movable contact assembly contact arm before reaching the movable contact. See, e.g., U.S. Pat. No. 4,245,203. In this configuration, the rotation of the contact arm is influenced, in part, by the lateral pressure or torque applied to the contact arm by the slotted conductor. It is noted that, in this configuration, the lateral bias torque is created by friction. As the friction is affected by the contacting surface area on the yoke and the movable contact assembly contact arms, manufacturing tolerances and other factors affect the torque. That is, the level of torque balance control could be improved.

In this configuration, the movable contact assembly is limited to a maximum of two contact arms. That is, the lateral bias applied by the yoke must apply bias in a controlled manner to the movable contact assembly contact arms so as to control the blow open characteristics of each arm. This is only possible with a two-arm configuration because the torqued applied by a yoke to a medial contact arm, i.e., a contact arm between two other contact arms, cannot be controlled. That is, because the fingers typically have the same geometry, i.e., same shape, and rotate about the same axle, the contact area between the adjacent surface of each finger could be large or small. That is, the "contact area" is variable due to the roughness/smoothness of each surface resulting in a different number of contact points over each surface, warping of the contact fingers, and other factors that affect the total area in actual contact on each contact finger lateral surface. This variable contact surface area creates a difference in the surfaces' coefficient of friction and variations in the coefficient of friction over a single contact finger lateral surface. Thus, when the contact fingers are compressed laterally, each finger is subject to a variable torque due to the differences in friction. In a two-finger configuration, each finger is subjected to friction created by the yoke, which due to the smaller contact area is negligible relative to the larger lateral surface contact area, and the lateral surface contact area. When there are two contact fingers, the friction acting on the lateral surface contact area is the same because it is the same lateral surface contact area. That is, by definition, the lateral surface contact area of a first contact arm disposed against a second contact arm is the same as the lateral surface contact area of that second contact arm disposed against that first contact arm.

This is not true of a stack of three or more contact arms. By way of an analogy, imagine assembling three or more paper plates in a stack with a central axle through the stack. Depending on how they are assembled, the flatness, or non-flatness, creates more or less friction between adjacent plates. If a rotational force was applied equally to each plate, the plates would spin at different rates due to the differences in friction between adjacent plates. This is true of contact arms as well.

This is a disadvantage because the rating, i.e., withstand value, or, the size, of the circuit breaker is limited by the size of the movable contact assembly contact arms. That is, for a higher rating, the size of the movable contact assembly contact arms, and therefore the size of the circuit breaker, must be increased.

Thus, there is a problem with the size and configuration of clinch joint assemblies. As noted above, the level of torque balance control could be improved while accommodating manufacturing tolerances. Further, the limited number of movable contact assembly contact arms allowed by present clinch joint assemblies is a problem.

An electrical switching apparatus with a higher withstand value may include elements of both a movable contact assembly and a clinch joint assembly. That is, an air circuit breaker is structured to withstand greater currents and thereby allow downstream circuit breakers to open during a relatively less intense over-current event. Thus, by way of example, a single room in a hospital may have its power interrupted, rather than the entire wing of the hospital. During a relatively more intense over-current event, the air circuit breaker will open. Moreover, during such an over-current event, it is better for the air circuit breaker to open as quickly as possible. This is accomplished by having a number of fingers on an air circuit breaker clinch joint assembly "blow open," i.e., pivot quickly, in response to a magnetic field generated by the over current condition. Further, in response to a trip unit detecting the same over current condition, the air circuit breaker operating mechanism will be actuated and move the entire air circuit breaker clinch joint assembly away from the stationary contacts. Thus, the movable contact assembly contact arms "blow open" first, then the entire clinch joint assembly is moved away from the stationary contacts. Because the clinch joint assembly is not fixed to the conductor, the movable contact assembly included shunts to couple, and provide electrical communication between, the conductor and the clinch joint assembly. In view of the higher voltage for which an air circuit breaker is rated, the amount of "wiggle" a shunt experiences during an over current condition is increased. That is, an air circuit breaker that utilizes a moving clinch joint assembly is subject to the problems of both clinch joint assemblies and shunts noted above.

There is a need, therefore, for elements of the movable contact assembly (e.g., shunts) which solve the problems noted above. There is a further need for elements of the movable contact assembly (e.g., a clinch joint assembly) which solve the problems noted above. Accordingly, there is room for improvement of conductor assemblies for electrical switching apparatus such as, for example, air circuit breakers.

SUMMARY

The disclosed and claimed concept addresses the problems and needs noted above by providing a movable contact assembly for an electrical switching apparatus. The movable contact assembly includes a number of shunts, and, a carriage assembly including two sidewalls and a contact arm assembly. The carriage assembly sidewalls are disposed in a spaced relation. The contact arm assembly includes a plurality of contact arms, a number of isolation members, a number of movable contacts, and an axle. Each contact arm defines an opening. One movable contact is disposed on each contact arm. Each contact arm is rotatably coupled to the axle with the axle extending through the contact arm opening. Each isolation member is disposed adjacent at least one contact arm. Each isolation member is coupled to, and in electrical communication with the adjacent contact arm. The shunts are coupled to, and in electrical communication with, the isolation members. In this configuration, the area of each contact arm that frictionally engages another element is limited to the isolation member. This frictional force generated by the smaller contact area may be more easily controlled. Further, in this configuration, no shunt operatively engages a contact arm.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
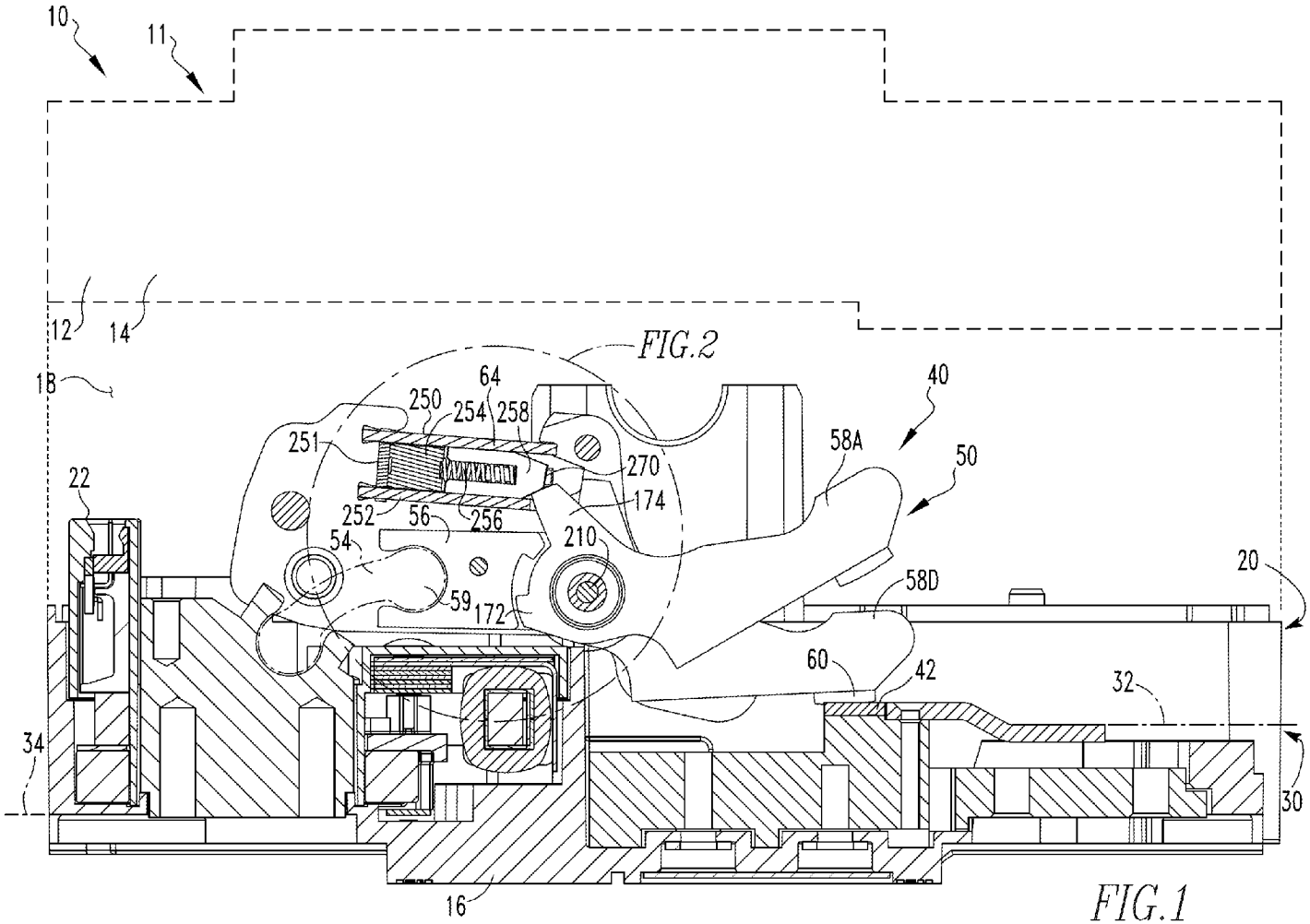
FIG. 1 is a partially exploded section view of a circuit breaker, in accordance with a non-limiting embodiment of the disclosed concept, showing the cover in simplified form.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the word "unitary" means a component is created as a single piece or unit. That is, a component that includes pieces that are created separately and then coupled together as a unit is not a "unitary" component or body. Further, as used herein, the portions or elements of a "unitary" body are "coupled" together.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut. It is further understood that an opening or passage through which another coupling component extends is also a coupling component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, a first object resting on a second object, which is held in place only by gravity, is not "coupled" to the second object unless the first object is otherwise linked to the second object. That is, for example, a book on a table is not coupled thereto, but a book glued to a table is coupled thereto.

As used herein, "temporarily coupled" means that two components are coupled in a manner that allows for the components to be easily decoupled without damaging the components. For example, elements that are coupled by a nut/bolt coupling are "temporarily coupled," while elements that are welded together are not.

As used herein, the statement that two or more parts or components "engage" one another shall mean that the elements exert a force or bias against one another either directly or through one or more intermediate elements or components.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw; however, when a rotational force is applied to the screwdriver, the screwdriver "operatively engages" the screw and causes the screw to rotate. As used herein, "operatively engage" means "engage and maintain in a selected position." That is, a compressed spring held in place by a latch is "operatively engaged" by the latch in that the latch maintains the spring in a compressed state.

As used herein, the term "number" shall mean one or an integer greater than one (i.e., a plurality).

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening is made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit. Further, as used herein, "loosely correspond" means that a slot or opening is sized to be larger than an element disposed therein. This means that the increased size of the slot or opening is intentional and is more than a manufacturing tolerance. Further, with regard to a surface formed by two or more elements, a "corresponding" shape means that surface features, e.g., curvature, are similar.

As used herein, "structured to [verb] or 'be an [X]'" means that the identified element or assembly has a structure that is shaped, sized, disposed, coupled and/or configured to perform the identified verb or to be what is identified in the infinitive phrase. For example, a member that is "structured to move" is movably coupled to another element and includes elements that cause the member to move or the member is otherwise configured to move in response to other elements or assemblies. As such, as used herein, "structured to [verb] or 'be an [X]'" recites structure and not function. Further, as used herein, "structured to [verb] or 'be an [X]'" means that the identified element or assembly is intended to, and is designed to, perform the identified verb or to be an [X]. Thus, an element that is only possibly "capable" of performing the identified verb but which is not intended to, and is not designed to, perform the identified verb is not "structured to [verb] or 'be an [X]'."

As used herein, a "path" or "path of travel" is the space an element moves through when in motion.

As used herein, and in reference to a clinch joint assembly, "float" or "floatably coupled" means that elements that are rotatably coupled to an axle are not subject to any lateral compression and/or engagement by a carriage sidewall, that the elements that are rotatably coupled to an axle may shift longitudinally on the axle, and, that any friction created by compression forces generate a "substantially equivalent friction." That is, each contact arm rotatably disposed on the same axle is exposed to substantially the same frictional forces. It is understood that the frictional forces that a contact arm is exposed to are substantially created by engagement (i.e., bias) on the lateral sides of the contact arm. It is understood that those of skill in the art understand how to control the friction on the lateral sides of the contact arm. As an example, a first contact arm may have relatively small lateral contact surfaces with a relatively greater coefficient of friction with adjacent elements while a second contact arm may have relatively large lateral contact surface with a relatively lower coefficient of friction; if the friction generated on the first and second contact arms is generally equivalent, then the first and second contact arms are subjected to "substantially equivalent friction" and "float" on the axle.

As used herein, a "reduced friction" is the friction created by an element engaging and rotating against a "reduced engagement area." As used herein, a "reduced engagement area" means an area between about 1% and 85% of the surface area of one of the contact arm body lateral surfaces 166, 168. As used herein, a "very reduced friction" is the friction created by an element engaging and rotating against a "very reduced engagement area." As used herein, a "very reduced engagement area" means an area between about 1% and 50% of the total surface area of the contact arm body lateral surfaces 166, 168. As used herein, an "extremely reduced friction" is the friction created by an element engaging and rotating against an "extremely reduced engagement area." As used herein, an "extremely reduced engagement area" means an area between about 1% and 15% of the total surface area of the contact arm body lateral surfaces 166, 168.

As used herein, and in reference to a clinch joint assembly, "freely" when used to modify "float" or "floatably coupled" means, in addition to "float[ing]" as defined above, that elements rotatably disposed on an axle are not subject to any substantial frictional forces about the axle. Stated alternately, when an element defines an opening that corresponds to the axle, or is larger than the axle, the minimal friction is not substantial and the element "freely floats" on the axle.

As used herein, and in reference to a clinch joint assembly, "fully" when used to modify "float" or "floatably coupled" means that the rotational elements coupled to an axle may move longitudinally over substantially the entire length of the axle. That is, each element cannot move over substantially the entire length of the axle, but collectively, the elements are not limited from moving over substantially the entire length of the axle by a construct such as, but not limited to a flange disposed on the medial portion of the axle.

As used herein, and in reference to a clinch joint assembly, "partially" when used to modify "float" or "floatably coupled" means that the rotational elements coupled to an axle may not move longitudinally over substantially the entire length of the axle. That is, elements are limited from moving over substantially the entire length of the axle by a construct such as, but not limited to a flange disposed on the medial portion of the axle. The elements disposed to one side of, or in between, the limiting construct(s) may move over the portion of the axle to that side of, or in between, the limiting construct(s). As before, this does not mean that each element disposed to one side of, or in between, the limiting construct(s) may move over the portion of the axle to that side of, or in between, the limiting construct(s), but rather, as a collection, the group of elements disposed to one side of, or in between, the limiting construct(s) may move over the portion of the axle to that side of, or in between, the limiting construct(s).

Figure 2:
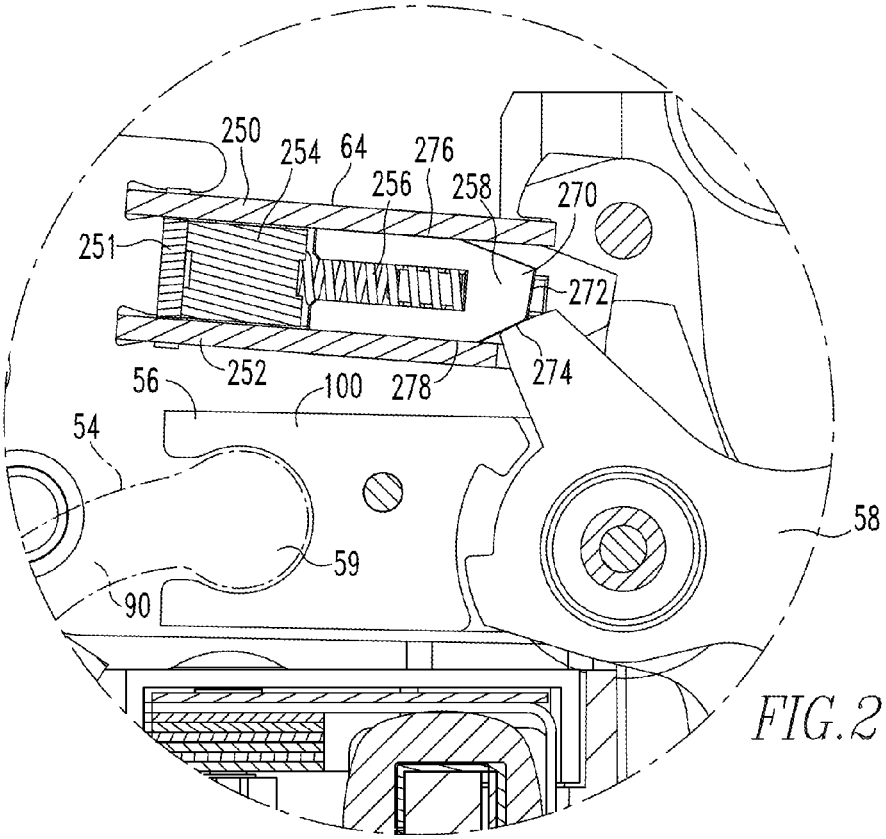
FIG. 2 is an enlarged view of a portion of a movable contact assembly.
Figure 5:
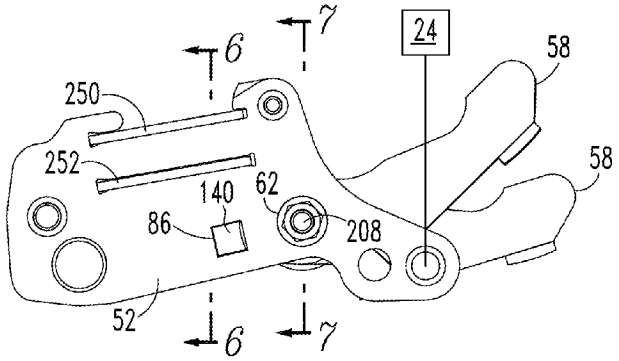
FIG. 5 is a side elevation view of the movable contact assembly of FIG. 4.

FIGS. 1 and 2 show an electrical switching apparatus 10, which in an exemplary embodiment is an air circuit breaker 11, including a housing assembly 12, a conductor assembly 20, a trip unit 22 (shown schematically) and an operating mechanism 24 (FIG. 5, shown schematically). The housing assembly 12 includes a first half or front part 14 (e.g., a molded cover) and a second half or back part 16 (e.g., a molded base), which, when joined define a substantially enclosed space 18. The conductor assembly 20, trip unit 22 and operating mechanism 24 are substantially disposed in the housing assembly enclosed space 18.

The conductor assembly 20 includes a number of pole assemblies 30 (one shown). That is, there is a similar set of conductor elements for each pole of the air circuit breaker 11. As the pole assemblies 30 are similar, only one will be described. Each pole assembly 30 includes a line conductor 32 (shown schematically), a contact assembly 40, and a load conductor 34 (shown schematically). Each of the line conductor 32 and load conductor 34 includes an external terminal (not shown) structured to be coupled to a line or load, respectively.

Each contact assembly 40 includes a stationary contact 42 and a movable contact assembly 50. The stationary contact 42 is, in an exemplary embodiment, coupled, directly coupled, or fixed to the line conductor 32. The movable contact assembly 50 includes a number of movable contacts 60, described below, that are structured to move between an open, first position, wherein the movable contacts 60 are not coupled to, and are not in electrical communication with, the stationary contact 42, and a closed, second position, wherein the movable contacts 60 are coupled to, and are in electrical communication with, the stationary contact 42. It is understood that the operating mechanism 24 is structured to move the movable contacts 60 between the two positions either manually or to move the movable contacts 60 from the second position to the first position in response to an actuation by the trip unit. Further, the movable contacts 60 are structured to "blow open" in response to an over current condition, as described below.

Figure 8:
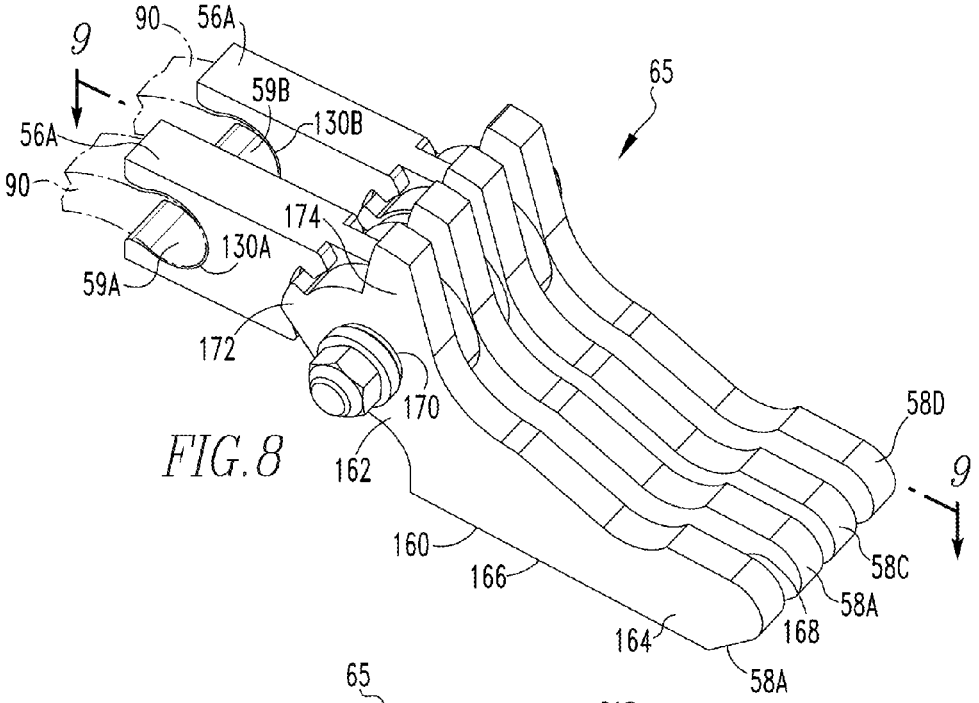
FIG. 8 is an isometric view of a contact arm assembly.

In an exemplary embodiment, each movable contact assembly 50 includes a carriage assembly 52, a number of shunts 54, a number of isolation members 56, a number contact arms 58, a number of movable contacts 60, an axle assembly 62 and a bias assembly 64. Further, as used herein, the combination of the number of shunts 54, the number of isolation members 56, the number contact arms 58, the number of movable contacts 60, and the axle assembly 62 shall be identified as the contact arm assembly 65 (FIG. 8). Further, the elements that are rotatably coupled to the axle assembly 62 are hereinafter collectively identified as the "rotating elements" 66. That is, as used herein, the "rotating elements" 66 include the isolation members 56 and the contact arms 58 as well as any medial spacers 63, described below as part of the axle assembly 62.

In an exemplary embodiment, the carriage assembly 52 is made from steel while the number of shunts 54, the number of isolation members 56, the number contact arms 58, and the number of movable contacts 60 are made from copper or another metal more conductive than steel.

Generally, and as described in detail below, the rotating elements 66 are floatably, or freely and floatably, coupled to the axle assembly 62. Thus, the contact arm assembly 65 is floatably, or freely and floatably, coupled to the carriage assembly 52. That is, the contact arms 58 generate a "substantially equivalent friction" during rotation. Further, in an exemplary embodiment, the contact arms 58 are compressed on the axle assembly 62 by a compression device 67. In an exemplary embodiment, the compression device 67 is a number of belleville washer 204, discussed below. The elements that engage the contact arms 58, due to, and including, the compression device 67 each have one of a reduced engagement area, a very reduced engagement area, or an extremely reduced engagement area. In this configuration, the friction forces are controllable, which solve the problems stated above.

Figure 3:
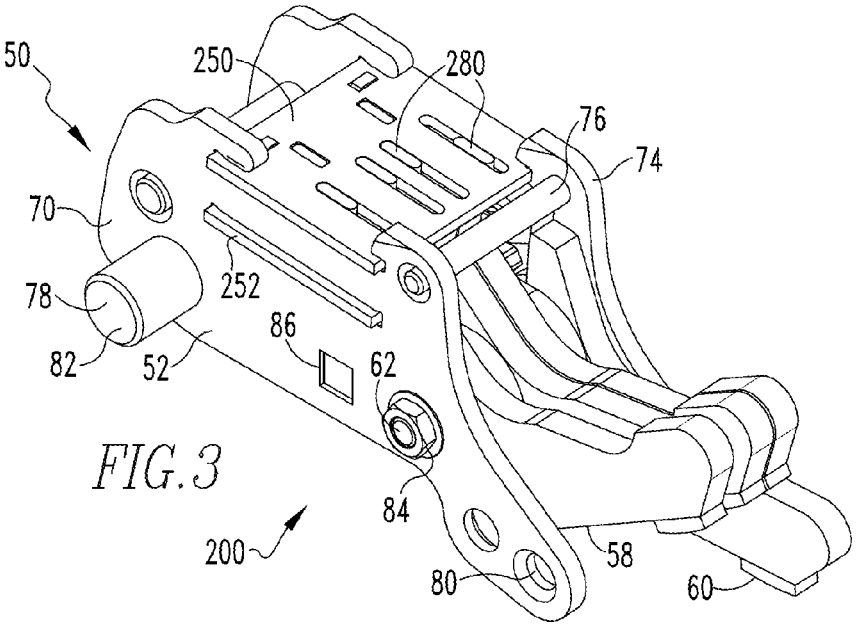
FIG. 3 is an isometric view of the movable contact assembly.
Figure 4:
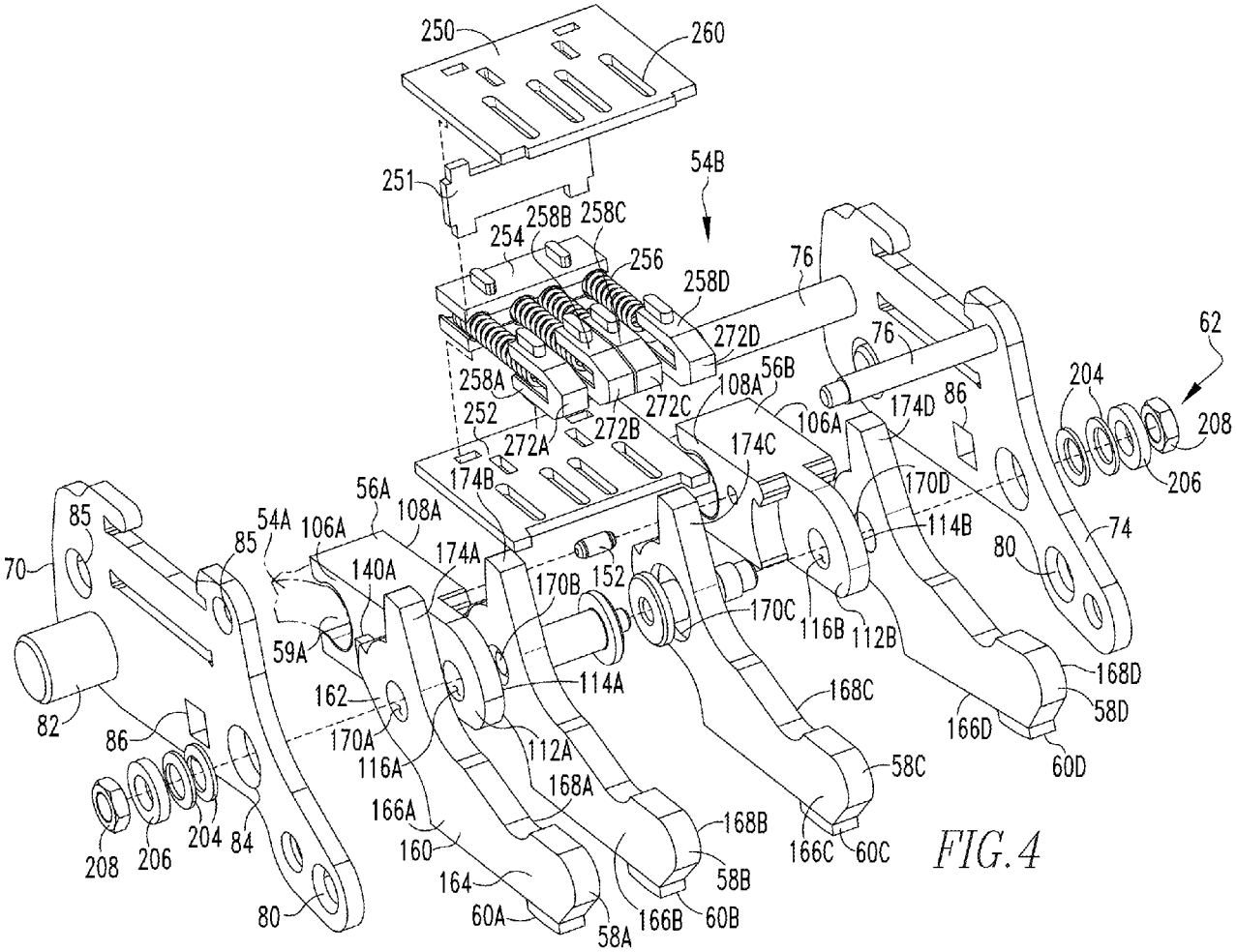
FIG. 4 is an exploded isometric view of the movable contact assembly of FIG. 3.

In an exemplary embodiment, as shown in FIGS. 3 and 4, the carriage assembly 52 includes two sidewalls; a first sidewall 70 and a second sidewall 74, and a number of spacers 76. Each carriage assembly sidewall 70, 74 includes an inner, lateral surface 71, 73 respectively. The spacers 76 are structured to, and do, maintain the carriage assembly sidewalls 70, 74 in a spaced relation. In an exemplary embodiment, the carriage assembly sidewalls 70, 74 define a pivot point 78 and an operating mechanism coupling 80. The carriage assembly pivot point 78 includes, in an exemplary embodiment, a circular lug 82 extending from each carriage assembly sidewall 70, 74. Each carriage assembly pivot point lug 82 is structured to be rotatably coupled to the housing assembly 12. The carriage assembly operating mechanism coupling 80 is, in an exemplary embodiment, spaced from the carriage assembly pivot point 78. In this configuration, when the operating mechanism 24 is actuated, the carriage assembly 52 pivots about the carriage assembly pivot point 78. The carriage assembly sidewalls 70, 74 each further define a number of mounting openings 85 for the spacers 76 and the bias assembly 64.

The carriage assembly sidewalls 70, 74 each further define an axle opening 84. Each axle opening 84 is generally circular. When the carriage assembly sidewalls 70, 74 are assembled, and disposed in a space relationship, the axle openings 84 are aligned. There are at least three variations of the axle assembly 62 coupling to the carriage assembly sidewalls 70, 74. That is, the axle assembly 62 is coupled to the carriage assembly sidewalls 70, 74 at the aligned axle openings 84 but, in one embodiment, the bias assembly 64 of the axle assembly 62, discussed below, is disposed within the axle openings 84. In another embodiment, the bias assembly 64 of the axle assembly 62 is disposed within, and against, the carriage assembly sidewalls 70, 74. In both these configurations, the axle assembly 62 is rotatably coupled to the carriage assembly sidewalls 70, 74. In another exemplary embodiment, the axle assembly 62 is fixed to the carriage assembly sidewalls 70, 74. That is, for example, the axle assembly 62 may include a non-circular portion and the axle openings 84 have a corresponding non-circular shape.

In an exemplary embodiment, each carriage assembly sidewall 70, 74 includes an anti-rotation lug opening 86. An anti-rotation lug opening 86 is sized and shaped to correspond to an anti-rotation lug 140 on an isolation member 56. Each anti-rotation lug opening 86 has a shape that is other than generally circular. As shown, each anti-rotation lug opening 86 is square.

As shown in FIGS. 1 and 8, each shunt 54 includes an elongated body 90. In an exemplary embodiment, each shunt body 90 has a length of about 1.5 inches, which, as used herein, is a "reduced length." That is, relative to the shunts discussed above, the shunts 54 disclosed herein have a "reduced length." Further, each shunt 54 is disposed in a "minimally curved configuration." As used herein, "in a minimally curved configuration" means a curvature of an arc with an inside radius of greater than about 0.4 inch. It is noted that a generally straight line is, as used herein, an arc with an infinite radius and is included within the definition of a "minimally curved configuration." A shunt 54 with a reduced length and which is disposed in a minimally curved configuration is only subjected to a minimal amount of deflection or "wiggle" during an over current event. Thus, a shunt 54 with a reduced length and which is disposed in a minimally curved configuration solves the problems stated above. In an exemplary embodiment, each shunt 54 also includes a rotational coupling element 57 which, in an exemplary embodiment, is a generally cylindrical lug 59, shown schematically.

Each isolation member 56 is structured to allow each contact arm 58 to float on the axle 210, described below, and to isolate the contact arms 58 from forces generated by the shunts 54. That is, as used herein and in reference to the isolation members 56, "isolate" or "isolation" means separating the bias created by the shunts 54 during an over current condition from the contact arms 58 and does not refer to electrical isolation or otherwise disrupting a current between the shunt 54 and the contact arms 58. In an exemplary embodiment, wherein there are four contact arms 58, as described below, there are two isolation members 56. The isolation members 56 are substantially similar so only one will be described.

As shown in FIGS. 10A-10C and 11A-11C, each isolation member 56 includes a body 100 having a front surface 102, a back surface 104, a first lateral surface 106 and a second lateral surface 108. In an exemplary embodiment, the isolation member body 100 has a thickness, i.e., the distance between the isolation member body first lateral surface 106 and the isolation member body second lateral surface 108, that is more than about three times the thickness of a contact arm body 160, described below. The isolation member body 100 also includes a contact arm 110 extending from the isolation member body front surface 102. The contact arm tab 110 includes a two lateral surfaces; a first lateral surface 112 and a second lateral surface 114. A contact arm tab opening 116 extends between the contact arm tab first lateral surface 112 and the contact arm tab second lateral surface 114. The contact arm tab opening 116 is generally circular and corresponds to the axle 210, described below.

In an exemplary embodiment, the contact arm tab 110 has a thickness, i.e., the distance between the contact arm tab first lateral surface 112 and the contact arm tab second lateral surface 114, that is about the same thickness of a contact arm body 160, described below. As described below, each of the contact arm tab lateral surfaces 112, 114 engages the contact arm body lateral surfaces 166, 168, described below. So as to allow each contact arm to "float," it is desirable to limit the contact between the contact arm body lateral surface 166, 168 and the contact arm tab lateral surfaces 112, 114. Accordingly, in an exemplary embodiment, each contact arm tab lateral surfaces 112, 114 has one of a "reduced engagement area," a "very reduced engagement area," or an "extremely reduced engagement area." With a "reduced engagement area," a "very reduced engagement area," or an "extremely reduced engagement area," the area of the contact arm body lateral surfaces 166, 168 subject to friction, as described below, is reduced (or very reduced/extremely reduced) thereby having a reduced and more controllable effect on the torque created when the contact arms 58 rotate. Thus, the "reduced engagement area," "very reduced engagement area," or "extremely reduced area" of the contact arm tab lateral surfaces 112, 114 solves the problems stated above.

In this configuration, the isolation member body front surface 102 is divided into a right side 120, contact arm tab 110 (described above), and a left side 122. The isolation member body front surface right side 120 and left side 122 are each a generally arcuate surface 126 with a radial lug 128. That is, the radial lug 128 is a lug that extends generally toward the center of the arc defined by the isolation member body front surface 102 at the right side 120 and left side 122.

Further, in an exemplary embodiment, and as noted above, the distance between the isolation member body first lateral surface 106 and the isolation member body second lateral surface 108, is more than about three times the thickness of a contact arm body 160. Further, the contact arm tab 110 thickness is about the same as the thickness of a contact arm body 160, described below. In this configuration, and when a contact arm body 160 is disposed on each side of the contact arm tab 110, the total thickness of the stack, i.e., the thickness of a contact arm body 160, a contact arm tab 110, and another contact arm body 160, is less than the thickness of the isolation member body 100. In this configuration, when the isolation member body 100 and the contact arm body 160 move laterally on axle assembly 62, the isolation member body 100 contacts, but does not engage, either carriage assembly sidewall 70, 74. Thus, the contact arm bodies 160 cannot contact either carriage assembly sidewall 70, 74 and create friction.

In an exemplary embodiment, the isolation member body back surface 104 defines a generally arcuate surface 130, wherein the isolation member body back surface arcuate surface 130 extends over a greater arc. Thus, the isolation member body back surface 104 defines a generally arcuate cavity 132. The cross-sectional area of the arcuate cavity 132 corresponds to the cross-sectional area of the rotational coupling element 57, i.e., the cross-sectional area of the shunt lug 59. In this configuration, the shunt lug 59 is structured to be rotatably coupled to the isolation member 56.

In an exemplary embodiment, the isolation member body first lateral surface 106 is generally planar, but includes a number of anti-rotation lugs 140. As shown, a single, non-circular anti-rotation lug 140 is provided. Each anti-rotation lug 140 is sized and shaped to correspond to an anti-rotation lug opening 86 on a carriage assembly sidewall 70, 74. It is noted that, in an embodiment (not shown) wherein there is a plurality of anti-rotation lugs 140, the anti-rotation lugs 140 and anti-rotation lug openings 86 may be generally circular.

In an exemplary embodiment, the isolation member body second lateral surface 108 is generally planar, but includes a number of alignment pin openings 150. The alignment pin openings 150 are sized and shaped to correspond to a number of alignment pins 152.

It is noted that the embodiment of the isolation members 56 described above is for an embodiment having two isolation members 56. In this configuration, the isolation member body first lateral surface 106 is that surface which is disposed adjacent a carriage assembly sidewall 70, 74 when assembled, as described below. Conversely, the isolation member body second lateral surface 108 is that surface which is disposed adjacent another isolation members 56, when assembled. Thus, it is understood that in an embodiment with three or more isolation members 56, only those isolation members 56 adjacent a carriage assembly sidewall 70, 74 would include an isolation member body first lateral surface 106 with an anti-rotation lug 140. Any medial isolation members 56 would include a first lateral surface 106 with a number of alignment pin openings 150 similar to the isolation member body second lateral surface 108.

In an exemplary embodiment, as shown in FIGS. 1, 4 and 8, each contact arm 58 is substantially similar and only one will be described. Each contact arm 58 includes an elongated body 160 having a first end 162, a second end 164, a first lateral surface 166 and a second lateral surface 168. In an exemplary embodiment, the contact arm body 160 is generally shaped as a "dog-leg." As used herein, a "dog-leg" shape includes a first elongated portion and a second elongated portion which meet at a vertex of the respective portions' longitudinal axes. The contact arm body first end 162 defines an axle opening 170, a stop 172 and a bias assembly actuator 174. The contact arm body first end axle opening 170 (hereinafter "contact arm opening" 170) is generally circular and sized and shaped to correspond to the cross-sectional area of the axle 210, discussed below. The contact arm opening 170 extends between the contact arm body first lateral surface 166 and contact arm body second lateral surface 168. In another exemplary embodiment, a contact arm opening 170 snuggly corresponds to the size and shape of the cross-sectional area of the axle 210.

In an exemplary embodiment, the contact arm body first end stop 172 (hereinafter "contact arm stop" 172) is a generally radial extension. That is, the contact arm stop 172 extends generally radially relative to the center of the contact arm opening 170. As described below, during a reset operation, the contact arm stop 172 contacts the isolation member body front surface radial lug 128. In an exemplary embodiment, the contact arm body first end bias assembly actuator 174 (hereinafter "contact arm actuator" 174) is also a generally radial extension. The contact arm actuator 174 is structured to operatively engage a bias assembly slider 258, described below, during an over current event.

A movable contact 60 is coupled, directly coupled, or fixed to each contact arm body second end 164. The movable contacts moves with the contact arm 58, as described below.

Figure 9A:
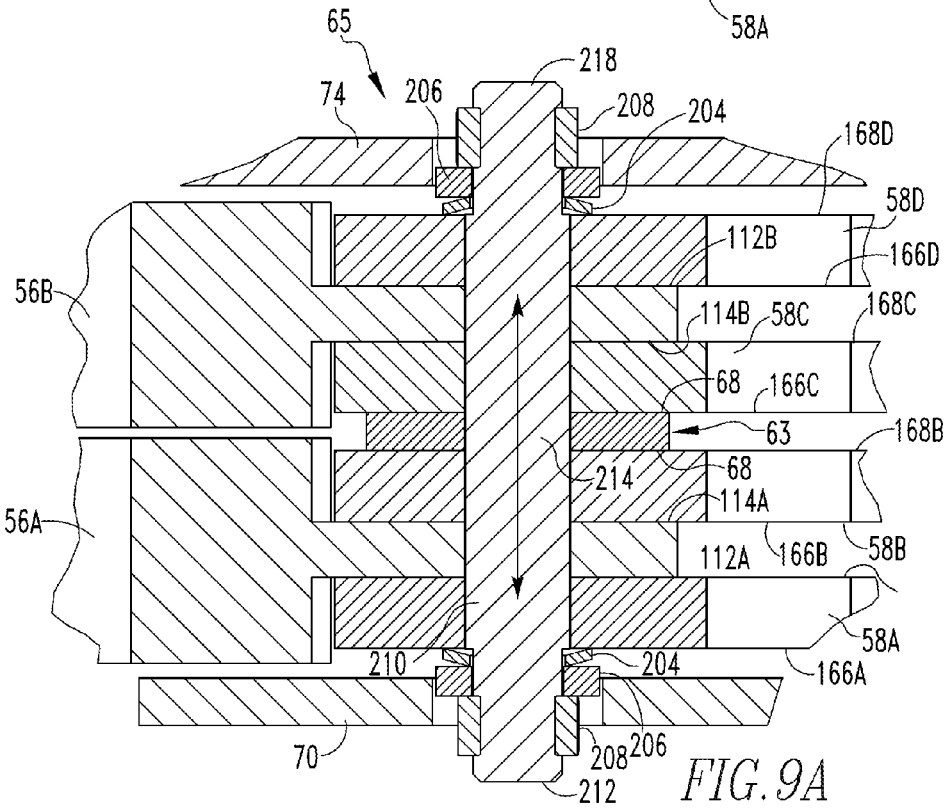
FIG. 9A is a section view of a contact arm assembly according to one embodiment.

In one exemplary embodiment, shown in FIG. 9A, the axle assembly 62 includes a generally cylindrical axle 210, a number of medial spacers 63 (one shown), a number of belleville washers 204, a number of guide sleeves 206, and a number of nuts 208. The medial spacers 63 have lateral surfaces 68 that are a "reduced engagement area," a "very reduced engagement area," or an "extremely reduced area," as described above. In this embodiment, the axle 210 is a unitary body without a medial flange. Further, axle 210 includes a threaded first end 212, a medial portion 214, and a threaded second end 218. That is, as used herein, the "axle first end" 212 and "axle second end" 218 are the threaded portions.

Figure 7:
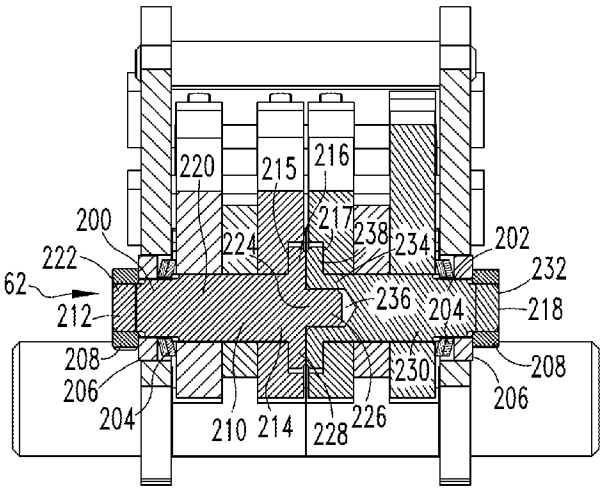
FIG. 7 is a section view taken along line 7-7 of FIG. 5.
Figure 6:
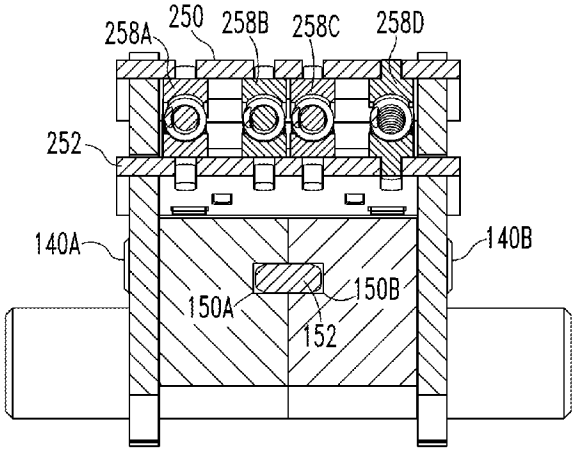
FIG. 6 is a section view taken along line 6-6 of FIG. 5.

In another exemplary embodiment, as shown in FIGS. 4, 7 and 9, the axle assembly 62 includes a first axle portion 200, a second axle portion 202, a number of a number of belleville washers 204, a number of guide sleeves 206, and a number of nuts 208. The first axle portion 200 and the second axle portion 202 are coupled to form an axle 210. In this exemplary embodiment, the first axle portion 200 includes an elongated, generally cylindrical body 220 having a first end 222 and a second end 224. The first axle portion first end 222 is threaded. The first axle portion second end 224 defines a male coupling 226. Further, the first axle portion second end 224 includes a flange 228. The second axle portion 202 includes an elongated, generally cylindrical body 230 having a first end 232 and a second end 234. The second axle portion first end 232 defines a female coupling 236. The second axle portion first end 232 also includes a flange 238. The second axle portion second end 234 is also threaded. When the first axle portion 200 and the second axle portion 202 are coupled to form the axle 210, axle 210 includes a first end 212 (which is the first axle portion body first end 222 and is threaded), a medial portion 214 (which includes the two flanges 228, 238, which abut each other and define a single "medial flange 216"), and a second end 218 (which is the second axle portion second end 234 and is threaded). That is, as used herein, the "axle first end" 212 and "axle second end" 218 are the threaded portions. The medial flange 216 has two lateral surfaces 215, 217 which define a "reduced engagement area," or a "very reduced engagement area," as defined above. That is, the cross-sectional area of the medial flange lateral surfaces 215, 217 is a "reduced engagement area" or a "very reduced engagement area." In an alternate embodiment, shown in FIG. 9, the axle 210 is a unitary body having the elements described in this paragraph.

In either of these embodiments, the axle 210 includes one or more non-circular portions that are structured to be disposed in non-circular axle openings 84 wherein the axle 210 is fixed to the carriage assembly sidewalls 70, 74, as described above.

The guide sleeves 206, in an exemplary embodiment, are generally disk-shaped. The belleville washers 204 and the guide sleeves 206 are structured to correspond to the axle ends 212, 218. The belleville washers 204 define a "reduced engagement area" or a "very reduced engagement area," as defined above. The nuts 208 are structured to correspond to the threaded portions of the axle ends 212, 218. Further, an outer surface 207 of the guide sleeves 206 is sized to correspond to the carriage assembly side plate axle openings 84.

The bias assembly 64, as shown in FIGS. 1, 2, and 4, includes an upper plate 250, a back plate 251, a lower plate 252, a spring mounting 254, a number of springs 256, and a number of sliders 258. The bias assembly upper plates 250 and lower plates 252 include a number of generally parallel guide slots 260. Each slider 258 includes a body 270 having an axial surface 272, an angled surface 274, an upper surface 276 and a lower surface 278. Further, on each slider upper surface 276 and lower surface 278 there is a guide member 280.

The bias assembly 64 is assembled as follows. The upper plate 250 and lower plate 252 are coupled to the back plate 251 and the spring mounting 254 and maintained in a spaced relation. Each slider 258 is disposed between the upper plate 250 and lower plate 252 with guide members 280 disposed in the slots 260. In this configuration, the movement of the sliders 258 are limited to travel over a generally straight path. That is, each slider 258 is structured to move between a forward, first position, and a retracted, second position. A spring 256 is disposed between each slider 258 and the spring mounting 254. The springs 256 bias each slider 258 to the first position. It is understood that the bias force generated by the springs 256 is controlled by the spring characteristics as is known in the art. That is, the springs 256 are structured to generate a selected bias force.

In an exemplary embodiment, the movable contact assembly 50 is assembled as follows. In an embodiment wherein the axle assembly 62 includes a first axle portion 200 and a second axle portion 202; the two axle portions 200, 202 are coupled, directly coupled, or fixed together forming the axle 210.

In this exemplary embodiment, as shown in FIGS. 3, 4, 8 and 9, there are four contact arms; a first contact arm 58A, a second contact arm 58B, a third contact arm 58C and a fourth contact arm 58D. Hereinafter, when used in reference to the contact arms 58 and their elements, the letter "A" shall identify elements of the first contact arm 58A, the letter "B" shall identify elements of the second contact arm 58B, and so forth.

In an embodiment wherein the axle assembly 62 includes medial spacer(s) 63, the medial spacer(s) 63 are disposed on the axle medial portion 214. Then, the second contact arm 58B is coupled to the axle 210 by passing axle second end 218 through contact arm opening 170B and is moved to the axle medial portion 214. The second contact arm body second lateral surface 168B abuts, i.e. is in contact with, a medial spacer lateral surface 68. The third contact arm 58C is coupled to the axle 210 by passing axle second end 218 through contact arm opening 170C and is moved to the axle medial portion 214. The third contact arm body first lateral surface 166C abuts another medial spacer lateral surface 68.

In this exemplary embodiment there is a first isolation member 56A and a second isolation member 56B. Hereinafter, when used in reference to the isolation members 56 and their elements, the letter "A" shall identify elements of the first isolation member 56A, the letter "B" shall identify elements of the second isolation member 56B. The first isolation member 56A is coupled to the axle 210 by passing axle first end 212 through contact arm tab opening 116A and is moved to the axle medial portion 214. The contact arm tab second lateral surface 114A abuts the second contact arm body first lateral surface 166B. The second isolation member 56B is coupled to the axle 210 by passing axle second end 218 through contact arm tab opening 116B and is moved to the axle medial portion 214. The contact arm tab first lateral surface 112B abuts the third contact arm body second lateral surface 168C.

Further, the first isolation member second lateral surface 108A abuts the second isolation member first lateral surface 106. The first and second isolation member alignment pin openings 150A, 150B are also aligned and an alignment pin 152 is disposed in, i.e., spanning both, the first and second isolation member alignment pin openings 150A, 150B.

The first contact arm 58A is coupled to the axle 210 by passing axle second end 218 through contact arm opening 170A and is moved to the axle medial portion 214. The first contact arm body second lateral surface 168A abuts, i.e., is in contact with, the first contact arm tab first lateral surface 112A. The fourth contact arm 58D is coupled to the axle 210 by passing axle second end 218 through contact arm opening 170D and is moved to the axle medial portion 214. The fourth contact arm body first lateral surface 166D abuts second contact arm tab second lateral surface 114B.

In an exemplary embodiment, two belleville washers 204 are disposed on the axle first end 212. A guide sleeve 206 is then disposed on the axle first end 212. Finally, a nut 208 is threadably coupled to the axle first end 212. Similarly, two belleville washers 204 are disposed on the axle second end 218. A guide sleeve 206 is then disposed on the axle second end 218. Finally, a nut 208 is threadably coupled to the axle second end 218. The two nuts 208 are then tightened. This action compresses the belleville washers 204. That is, the belleville washers 204 at the axle first end 212 engage the first contact arm first lateral surface 166A. Similarly, the belleville washers 204 at the axle second end 218 engage the fourth contact arm second lateral surface 168D. It is noted that the belleville washers 204 apply only a lateral bias to the outer contact arms 58A, 58D, which, in turn, compress the isolation members 56A, 56B and the inner contact arms 58B, 58C. Further, in an exemplary embodiment, each contact arm opening 170A, 170B, 170C, 170D corresponds to the axle 210. Thus, the contact arms 58A, 58B, 58C, 58D are structured to rotate freely about axle 210 with minimal friction. Further, as medial spacer 63 may move laterally (axially) on axle 210, the contact arms 58A, 58B, 58C, 58D and isolation members 56A, 56B, i.e., the rotating elements 66, fully float on axle 210.

Figure 9B:
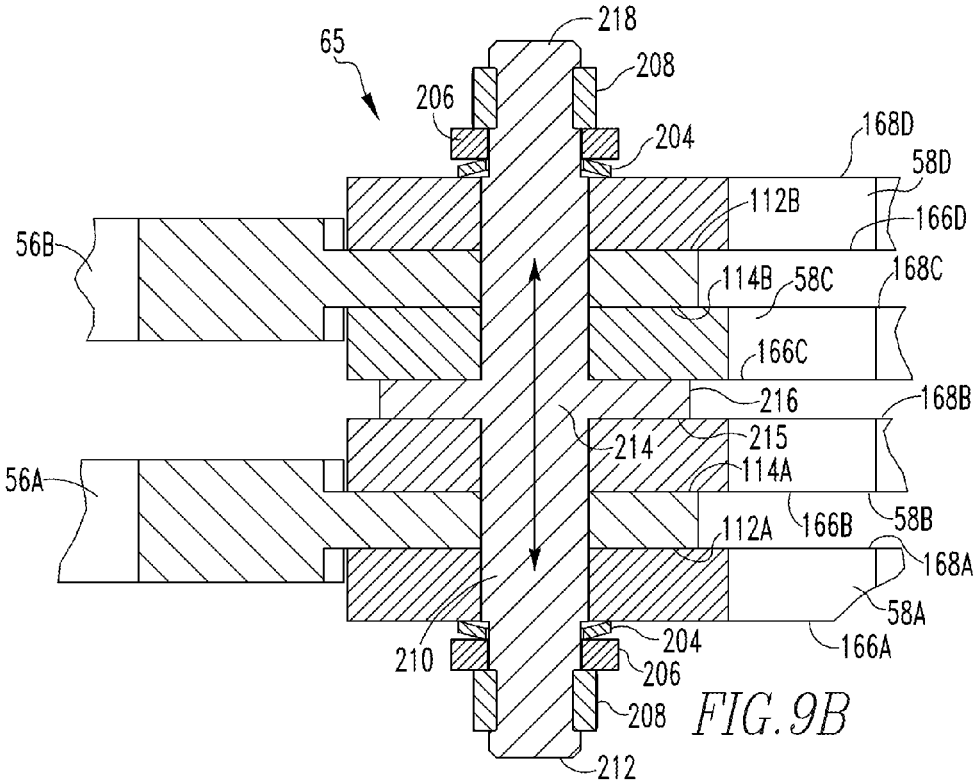
FIG. 9B is a section view of a contact arm assembly according to another embodiment.
Figure 9C:
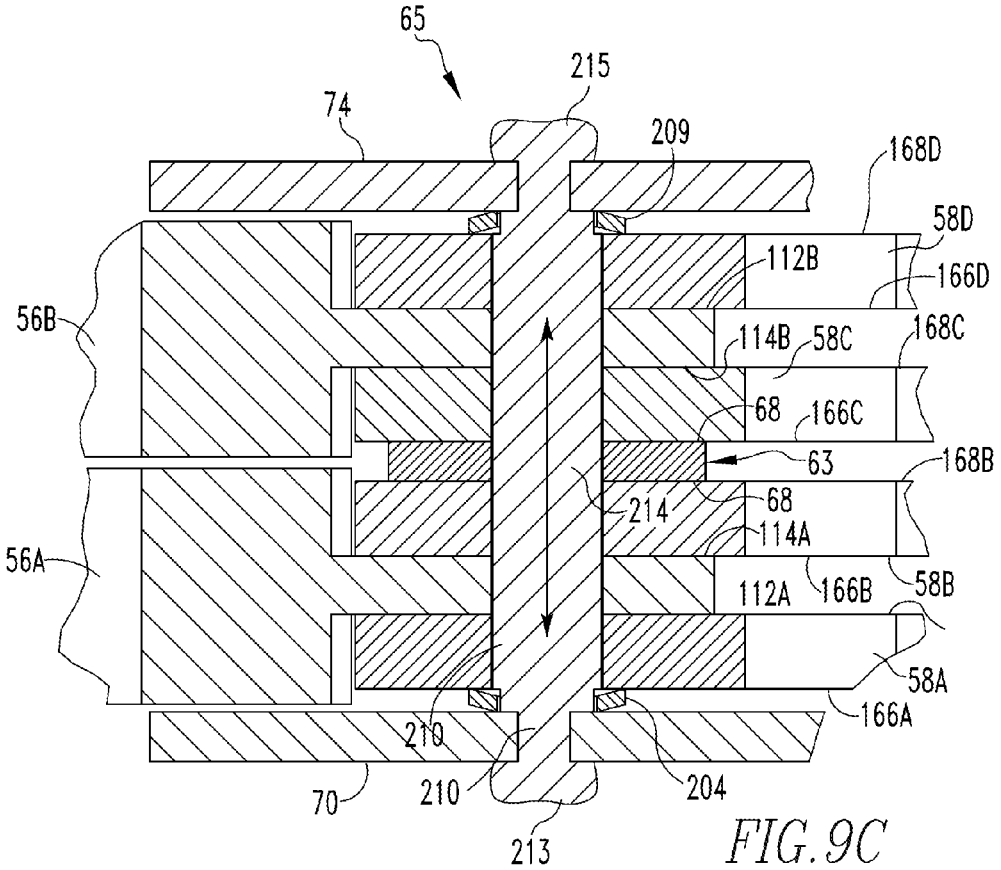
FIG. 9C is a section view of a contact arm assembly according to another embodiment.
Figure 10A:
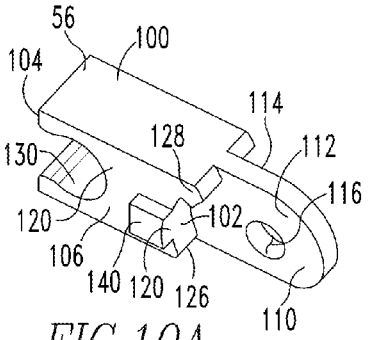
FIGS. 10A, 10B, 10C and 10D are isometric, top plan, side elevation, and bottom plan views, respectively, of a first isolation member.
Figure 10B:
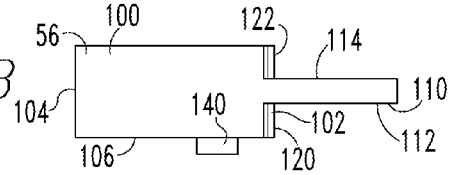
Figure 10C:
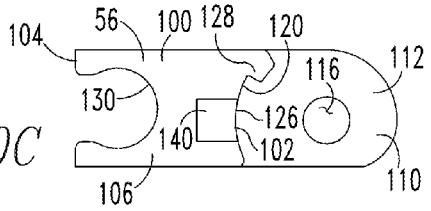
Figure 10D:
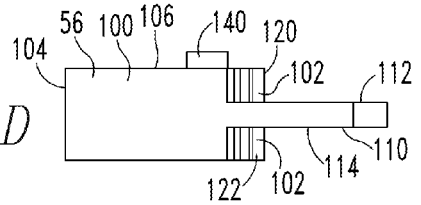
Figure 11B:
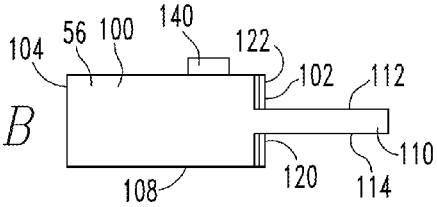
FIGS. 11A, 11B, 11C and 11D are isometric, top plan, side elevation, and bottom plan views, respectively, of a second isolation member.
Figure 11A:
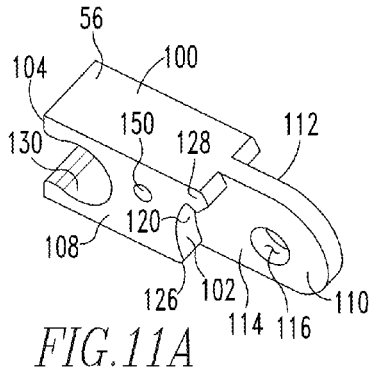
Figure 11C:
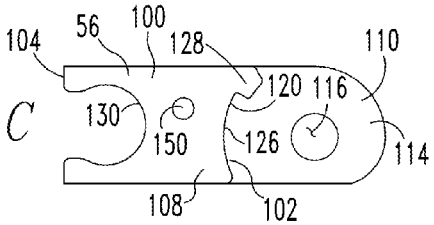
Figure 11D:
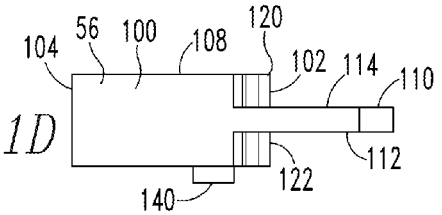

In another exemplary embodiment, shown in FIG. 9B, the axle assembly 62 include a medial flange 216. In this embodiment, the second contact arm 58B is coupled to the axle 210 by passing axle second end 218 through contact arm opening 170B and is moved to the axle medial portion 214. The second contact arm body second lateral surface 168B abuts, i.e., is in contact with, axle medial flange first lateral surface 215. The third contact arm 58C is coupled to the axle 210 by passing axle second end 218 through contact arm opening 170C and is moved to the axle medial portion 214. The third contact arm body first lateral surface 166B abuts axle medial flange second lateral surface 217.

In this exemplary embodiment there is a first isolation member 56A and a second isolation member 56B. Hereinafter, when used in reference to the isolation members 56 and their elements, the letter "A" shall identify elements of the first isolation member 56A, the letter "B" shall identify elements of the second isolation member 56B. The first isolation member 56A is coupled to the axle 210 by passing axle first end 212 through contact arm tab opening 116A and is moved to the axle medial portion 214. The contact arm tab second lateral surface 114A abuts the second contact arm body first lateral surface 166B. The second isolation member 56B is coupled to the axle 210 by passing axle second end 218 through contact arm tab opening 116B and is moved to the axle medial portion 214. The contact arm tab first lateral surface 112B abuts the third contact arm body first lateral surface 168C.

Further, the first isolation member second lateral surface 108A abuts the second isolation member first lateral surface 106. The first and second isolation member alignment pin openings 150A, 150B are also aligned and an alignment pin 152 is disposed in, i.e., spanning both, the first and second isolation member alignment pin openings 150A, 150B.

The first contact arm 58A is coupled to the axle 210 by passing axle second end 218 through contact arm opening 170A and is moved to the axle medial portion 214. The first contact arm body second lateral surface 168A abuts, i.e., is in contact with, the first contact arm tab first lateral surface 112A. The fourth contact arm 58D is coupled to the axle 210 by passing axle second end 218 through contact arm opening 170D and is moved to the axle medial portion 214. The fourth contact arm body first lateral surface 166D abuts second contact arm tab second lateral surface 114B.

In an exemplary embodiment, two belleville washers 204 are disposed on the axle first end 212. A guide sleeve 206 is then disposed on the axle first end 212. Finally, a nut 208 is threadably coupled to the axle first end 212. Similarly, two belleville washers 204 are disposed on the axle second end 218. A guide sleeve 206 is then disposed on the axle second end 218. Finally, a nut 208 is threadably coupled to the axle second end 218. The two nuts 208 are then tightened. This action compresses the belleville washers 204. That is, the belleville washers 204 at the axle first end 212 engage the first contact arm first lateral surface 166A. Similarly, the belleville washers 204 at the axle second end 218 engage the fourth contact arm second lateral surface 168D. It is noted that the belleville washers 204 apply only a lateral bias to the outer contact arms 58A, 58D, which, in turn, compress the isolation members 56A, 56B and the inner contact arms 58B, 58C. Further, in an exemplary embodiment, each contact arm opening 170A, 170B, 170C, 170D corresponds to the axle 210. Thus, the contact arms 58A, 58B, 58C, 58D are structured to rotate freely about axle 210 with minimal friction. Further, medial flange 216 does not move laterally (axially) on axle 210. Therefore, the contact arms 58A, 58B, 58C, 58D and isolation members 56A, 56B, i.e., the rotating elements 66, partially float on axle 210. That is, the rotating elements 66 on either side of the medial flange 216 float between associated nut 208 and the medial flange 216.

It is further noted that in this configuration, each contact arm body first end stop 172 is disposed adjacent an isolation member body front surface 102.

In an exemplary embodiment, the axle 210, with the contact arms 58 and isolation members 56 is rotatably coupled to the carriage assembly 52. That is, the axle first and second ends 212, 218 are disposed in, or through, the axle openings 84. In one exemplary embodiment, the two belleville washers 204 and the guide sleeve 206 are disposed generally within the axle openings 84 with the inner belleville washer 204 directly coupled to, and engaging, the adjacent contact arm 58. In another exemplary embodiment, shown in FIG. 9C, the nuts 208 are disposed outside the carriage assembly sidewalls 70, 74 and the belleville washers 204 are disposed inside the carriage assembly sidewalls 70, 74. As before, the inner belleville washer 204 is directly coupled to, and engaging, the adjacent contact arm 58. In another embodiment, the axle 210 includes one or more non-circular portions and the axle openings 84 have a corresponding non-circular shape. When the non-circular portions of the axle 210 are disposed in the non-circular axle openings 84, the axle 210 is fixed to the carriage assembly sidewalls 70, 74. It is understood that the axle 210 may be fixed to the carriage assembly sidewalls 70, 74 by other constructs as well. For example, the axle 210 may be welded or staked to the carriage assembly sidewalls 70, 74 (not shown).

In this configuration, the carriage assembly sidewalls 70, 74 are disposed in a spaced relationship. Additional spacers 76 are coupled to both carriage assembly sidewalls 70, 74. Further, the bias assembly 64 is coupled to the carriage assembly sidewalls 70, 74 with each slider 258 disposed adjacent a contact arm actuator 174. Further, each anti-rotation lug 140A, 140B is disposed in an anti-rotation lug opening 86 on a carriage assembly sidewall 70, 74. In this configuration, the isolation members 56A, 56B are fixed to the carriage assembly sidewalls 70, 74. That is, the isolation members 56A, 56B cannot rotate about axle 210 and maintain their orientation relative to the carriage assembly sidewalls 70, 74.

Thus, in this configuration, the rotating elements 66 are floatably, or freely and floatably, coupled to the axle assembly 62. Further, the contact arm assembly 65 is floatably, or freely and floatably, coupled to the carriage assembly 52. Further, in an embodiment wherein the axle assembly 62 includes a medial spacer 63, the rotating elements 66 fully float on axle 210. In an embodiment wherein the axle 210 includes a medial flange 216, the rotating elements 66, partially float on axle 210.

In an exemplary embodiment there are two shunts 54; a first shunt 54A and a second shunt 54B. Each shunt lug 59A, 59B, is rotatably coupled to an associated isolation member 56A, 56B. That is, each shunt lug 59A, 59B is rotatably disposed in the cavity defined by isolation member body back surface arcuate surface 130A, 130B.

In this configuration, the movable contacts 60A, 60B, 60C, 60D are structured to "blow open" during an over current event. That is, the contact arms 58A, 58B, 58C, 58D are structured to move between a "blow open" position and the movable contacts 60A, 60B, 60C, 60D second position, described above. As shown in FIG. 8, when movable contacts 60A, 60B, 60C, 60D are in the second position, each movable contact 60A, 60B, 60C, 60D is in contact, and electrical communication with, a stationary contact 42. When current passes through the contact assembly 40, electro-magnetic forces bias each movable contact 60A, 60B, 60C, 60D away from the associated stationary contact 42. Each movable contact 60A, 60B, 60C, 60D is maintained in the second position by the bias assembly 64.

That is, each slider 258A, 258B, 258C, 258D engages an associated contact arm actuator 174A, 174B, 174C, 174D. In an exemplary embodiment, each slider axial surface 272A, 272B, 272C, 272D engages an associated contact arm actuator 174A, 174B, 174C, 174D. The bias of the sliders 258A, 258B, 258C, 258D is sufficient to overcome the electro-magnetic forces acting on the each contact arms 58A, 58B, 58C, 58D under normal conditions. When an over current condition occurs, the electro-magnetic forces acting on the each contact arms 58A, 58B, 58C, 58D increases and overcomes the bias of the sliders 258A, 258B, 258C, 258D. When this happens, as shown in FIGS. 1 and 3, a contact arm actuator 174A, 174B, 174C (the fourth contact arm 58D is shown in the second position) compresses the associated spring 256 and allows the contact arm actuator 174A, 174B, 174C, to move under slider angled surface 274. This is the "blow open position."

That is, when the contents are in the "blow open position," the operating mechanism 24, and therefore carriage assembly 52, are still in the first position while the contacts 42, 60 are separated. Further, it is understood that any number of contact arms 58A, 58B, 58C, 58D may blow open independently of the other contact arms 58A, 58B, 58C, 58D. When one contact arm 58A, for example, blows open, however, the current instantaneously starts to move through the other contact arms 58B, 58C, 58D. This increase in current through the other contact arms 58B, 58C, 58D causes those contact arms 58B, 58C, 58D to blow open a split second later. This split second different is not relevant to this invention and the contact arms 58A, 58B, 58C, 58D effectively move to the blow open position at the same time.

When the contact arms 58A, 58B, 58C, 58D are in the blow open position, the sliders 258A, 258B, 258C, 258D are biased against the associated contact arm actuator 174A, 174B, 174C, 174D and prevent the contact arms 58A, 58B, 58C, 58D from returning to the second position. When the operating mechanism 24 is actuated, thereby moving the carriage assembly 52 to the first position, the contact arms 58A, 58B, 58C, 58D engage a stop device (not shown in detail) such as the housing assembly front part 14. This engagement overcomes the bias of the sliders 258A, 258B, 258C, 258D and rotates contact arms 58A, 58B, 58C, 58D to the first position. Rotation of the contact arms 58A, 58B, 58C, 58D is stopped when each contact arm body first end stop 172A, 172B, 172C, 172D engages an isolation member body radial lug 128.

In this configuration, no shunt 54A, 54B operatively engages a contact arm 58A, 58B, 58C, 58D. That is, because each shunt 54A, 54B is coupled to an isolation member 56A, 56B, and because each isolation member 56A, 56B is fixed to the carriage assembly 52, any force generated by a shunt 54A, 54B during an over current condition is not transferred to the contact arms 58A, 58B, 58C, 58D. Further, in this configuration, the contact arm assembly 65 is rotatably and floatably coupled to said carriage assembly 52. That is, the carriage assembly 52 applies no lateral force on the contact arm assembly 65. Further, the contact arms 58A, 58B, 58C, 58D only rotate against, i.e., create friction against, the contact arm tab lateral surfaces 112, 114, the medial flange lateral surfaces 215, 217 and the belleville washers 204, all of which define a "reduced engagement area," a "very reduced engagement area," or an "extremely reduced area." Thus, the contact arms 58A, 58B, 58C, 58D generate only a reduced friction, a very reduced friction, or an extremely reduced friction. Moreover, in any embodiment, the friction is also a "substantially equivalent friction."

That is, in an exemplary embodiment, the "reduced engagement area," "very reduced engagement area," or "extremely reduced area," of the contact arm tab lateral surfaces 112, 114, the medial spacer lateral surfaces 68 or the medial flange lateral surfaces 215, 217 and the belleville washers 204 are generally equivalent, and, the coefficient of friction between the contact arms 58A, 58B, 58C, 58D and the elements above 112, 114, 215, 217, 204 is generally equivalent. Thus, the frictional forces are generally balanced and the contact arms 58A, 58B, 58C, 58D float relative to the axle 210 and/or the carriage assembly 52. Stated alternately, the contact arms 58A, 58B, 58C, 58D, are floatably coupled to the axle 210 and/or the carriage assembly 52. Further stated alternately, the contact arm assembly 65 is floatably coupled the carriage assembly 52.

In an exemplary embodiment, each contact arm opening 170 corresponds to the axle 210; that is, each contact arm opening 170A, 170B, 170C, 170D is slightly larger than the axle 210 whereby there is negligible friction between the contact arms 58A, 58B, 58C, 58D and the axle 210. Thus, the contact arms 58A, 58B, 58C, 58D freely float relative to axle 210 and/or the carriage assembly 52. Stated alternately, the contact arms 58A, 58B, 58C, 58D are freely and floatably coupled to the axle 210 and/or the carriage assembly 52. Further stated alternately, the contact arm assembly 65 is freely and floatably coupled the carriage assembly 52. The contact arm openings 170A, 170B, 170C, 170D are not so large, however, so as to have an arcing gap between the contact arms 58A, 58B, 58C, 58D and the axle 210. As used herein, an "arcing gap" is a gap having a size sufficient to allow an arc to form.

In an alternate embodiment, one or more contact arm openings 170A, 170B, 170C, 170D snuggly corresponds to the axle 210. Thus, when a contact arm 58A, 58B, 58C, 58D with a snuggly corresponding contact arm opening 170 moves from the second position to the blow open position, the axle 210 also rotates, thereby moving the other contact arms 58A, 58B, 58C, 58D to the blow open position.

It is further noted that in this configuration, i.e., a configuration wherein the contact arm assembly 65 is rotatably and floatably coupled to said carriage assembly 52, there may be more than two contact arms 58 because the loads on each arm is controlled for the reasons stated above. Further, as noted above, each shunt 54A, 54B has a reduced length and is disposed in a minimally curved configuration. A shunt 54A, 54B with a reduced length and disposed in a minimally curved configuration does not cause, and is not subjected to, extreme compound deflection. Thus, the problems noted above are solved by the configuration of the movable contact assembly 50 disclosed herein.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A movable contact assembly for an electrical switching apparatus, said electrical switching apparatus including a housing assembly and a conductor assembly, said housing assembly defining an enclosed space, said conductor assembly substantially disposed in said housing assembly enclosed space, said conductor assembly including a load conductor, said movable contact assembly comprising:

a carriage assembly including two sidewalls and a contact arm assembly;

said carriage assembly sidewalls disposed in a spaced relation;

said contact arm assembly including rotating elements, and an axle assembly;

said axle assembly including an axle;

said rotating elements rotatably disposed on said axle; and wherein said rotating elements are floatably coupled to said axle.

2. The movable contact assembly of claim 1 wherein said rotating elements are one of fully floatably coupled to said axle, partially floatably coupled to said axle, freely floatably coupled to said axle, frilly and freely floatably coupled to said axle, or partially and freely floatably coupled to said axle.

3. The movable contact assembly of claim 1 wherein said contact arm assembly is compressed on the axle assembly by a compression device.

4. The movable contact assembly of claim 1 wherein said contact arm assembly is rotatably and floatably coupled to said carriage assembly.

5. The movable contact assembly of claim 1 wherein:

said rotating elements include a plurality of contact arms and a number of isolation members;

wherein each isolation member includes a body;

each isolation member body includes a contact arm tab;

each contact arm tab including two lateral surfaces; and each contact arm tab lateral surface has one of a reduced engagement area, a very reduced engagement area, or an extremely reduced engagement area.

6. The movable contact assembly of claim 5 wherein:

said plurality of contact arms includes at least three contact arms; and wherein said at least three contact arms are disposed on a single axle.

7. The movable contact assembly of claim 1 wherein:

said axle assembly includes a spacer including two lateral surfaces and defining an opening; and said spacer lateral surfaces have one of a reduced engagement area, a very reduced engagement area, or an extremely reduced engagement area.

8. The movable contact assembly of claim 7 wherein:

said rotating elements include a plurality of contact arms and a number of isolation members;

said plurality of contact arms includes a first contact arm, a second contact arm, a third contact arm, and a fourth contact arm;

said number of isolation members includes a first isolation member and a second isolation member;

said first isolation member and said second isolation member each including a contact arm tab;

each said isolation member contact arm tab defining an opening;

each said isolation member coupled to said axle with said axle extending through said isolation member contact arm tab opening;

said first isolation member contact arm tab disposed between, and in electrical communication with, said first contact arm and said second contact arm;

said second isolation member contact arm tab disposed between, and in electrical communication with, said third contact arm and said fourth contact arm; and said axle assembly spacer disposed between, and in electrical communication with, said second contact arm and said third contact arm.

9. A movable contact assembly for an electrical switching apparatus, said electrical switching apparatus including a housing assembly and a conductor assembly, said housing assembly defining an enclosed space, said conductor assembly substantially disposed in said housing assembly enclosed space, said conductor assembly including a load conductor, said movable contact assembly comprising:

a number of shunts;

a carriage assembly including two sidewalls and a contact arm assembly;

said carriage assembly sidewalls disposed in a spaced relation;

said contact arm assembly including a plurality of contact arms, a number of isolation members, a number of movable contacts, and an axle assembly;

said axle assembly including an axle;

each contact arm defining an opening;

one said movable contact disposed on each said contact arm;

each said contact arm rotatably coupled to said axle with said axle extending through said contact arm opening;

each said isolation member disposed adjacent at least one contact arm;

each isolation member coupled to, and in electrical communication with said adjacent contact arm;

said shunts coupled to, and in electrical communication with, said isolation members; and wherein no shunt operatively engages a contact arm.

10. The movable contact assembly of claim 9 wherein each shunt has a reduced length and is disposed in a minimally curved configuration.

11. The movable contact assembly of claim 9 wherein each shunt has a minimally curved configuration.

12. The movable contact assembly of claim 9 wherein each shunt has a reduced length.

13. The movable contact assembly of claim 9 wherein each isolation member is fixed to one said carriage assembly sidewall.

14. The movable contact assembly of claim 9 wherein:

each shunt includes a rotational coupling element; and wherein each shunt rotational coupling element is a generally cylindrical lug.

15. An electrical switching apparatus comprising:

a movable contact assembly including a number of shunts, a carriage assembly, a contact arm assembly;

said contact arm assembly including a plurality of contact arms, a number of isolation members, and an axle assembly;

said axle assembly including an axle;

each contact arm defining an opening;

each said contact arm rotatably coupled to said axle with said axle extending through said contact arm opening;

each said isolation member including two contact surfaces;

each said isolation member disposed immediately adjacent and between two contact arms;

each isolation member contact surface coupled to, and in electrical communication with said adjacent contact arm;

said shunts coupled to, and in electrical communication with, one isolation member; and wherein each contact arm and each isolation member is floatably coupled to said axle.

16. The electrical switching apparatus of claim 15 wherein each contact arm and each isolation member is one of fully floatably coupled to said axle, partially floatably coupled to said axle, freely floatably coupled to said axle, fully and freely floatably coupled to said axle, or partially and freely floatably coupled to said axle.

17. The electrical switching apparatus of claim 15 wherein:

each isolation member includes a body;

each isolation member body includes a contact arm tab;

each contact arm tab including two lateral surfaces; and each contact arm tab lateral surface has one of a reduced engagement area, a very reduced engagement area, or an extremely reduced engagement area.

18. The electrical switching apparatus of claim 15 wherein:

said plurality of contact arms includes at least three contact arms; and wherein said at least three contact arms are disposed on a single axle.

19. The electrical switching apparatus of claim 15 wherein:

said shunts are coupled to, and in electrical communication with, said isolation members; and wherein no shunt operatively engages a contact arm.

20. The electrical switching apparatus of claim 15 wherein:

each shunt includes a rotational coupling element; and wherein each shunt is rotatably coupled to an associated isolation member.

* * * * *